US005528961A

United States Patent [19]

Paramest

[11] Patent Number: 5,528,961

[45] Date of Patent: Jun. 25, 1996

[54] ICE BUCKET CHAMPAGNE OPENER

[76] Inventor: Sam Paramest, 17407 3rd Ave. SE, Bothell, Wash. 98012

[21] Appl. No.: 412,003

[22] Filed: Mar. 28, 1995

[51] Int. Cl.[6] ..... B67B 7/06

[52] U.S. Cl. ..... 81/3.39; 81/3.32; 81/3.44; 81/3.09

[58] Field of Search ..... 81/3.31, 3.25, 81/3.32, 3.36, 3.29, 3.39, 3.08, 3.09, 3.15, 3.44; 7/151

[56] References Cited

U.S. PATENT DOCUMENTS 4,708,033 11/1987 Eash ..... 81/3.44 X

FOREIGN PATENT DOCUMENTS 5 of 1902 United Kingdom ..... 81/3.39

*Primary Examiner*—D. S. Meislin

[57] ABSTRACT

An ice bucket champagne opener apparatus, comprises: A cylinder ice bucket structure base to contain ice and a bottle of champagne. A lid attached and secured on the top of the ice bucket as an elevated base. The lid has a center round hole opening for the upper part of the champagne bottle to be set above the lid. A post support base is connected to the top of the lid to support an adjustable lever post. An elongated lever bar with a rear handle is connected pivotally across the top of the lever post. A cork container, which has the grasping means connected, is hung by a flexible connector with the front end of the lever bar. The cork container is floated above the lid and can be adjusted to slide to cover the champagne cork. The grasping means has a pair of cork grip flanges, which can be set to grasp and lock on the champagne cork. Whereby one can press the bottle down with one hand and press the lever bar with the other hand to tilt the cork container in pulling the cork off.

7 Claims, 2 Drawing Sheets

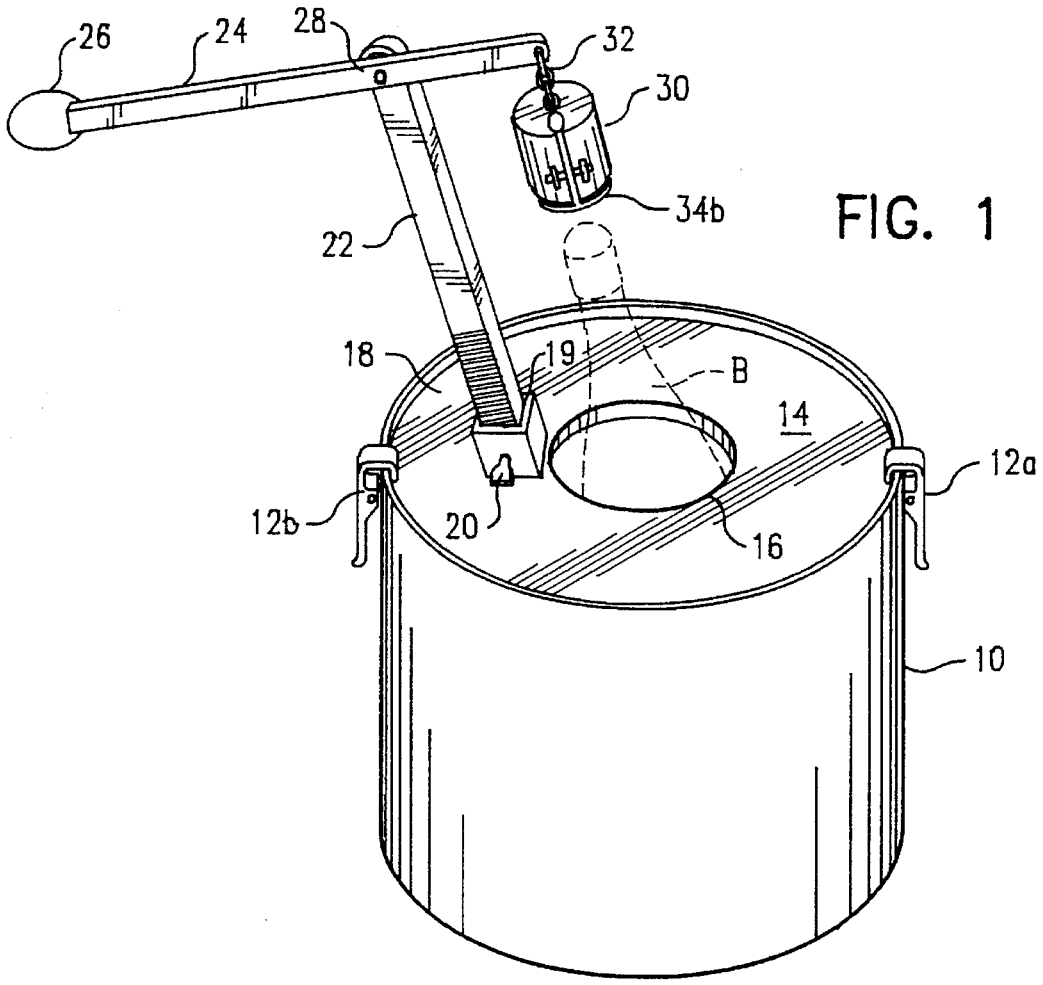
FIG. 1
FIG. 2
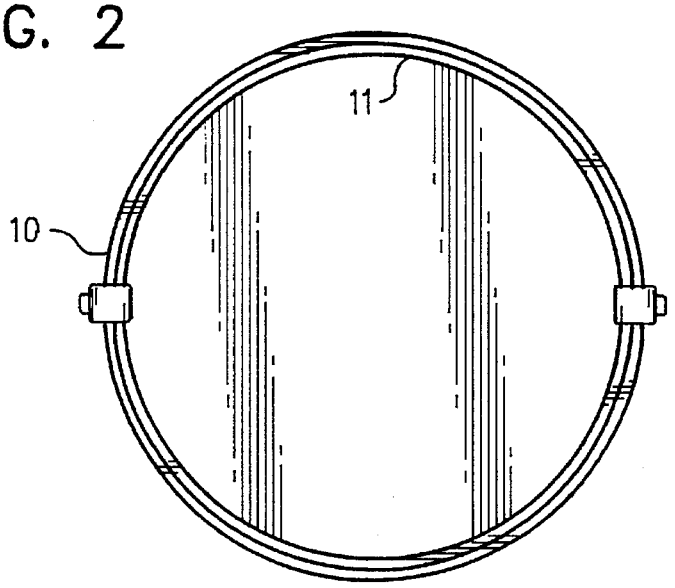

ICE BUCKET CHAMPAGNE OPENER

BACKGROUND OF INVENTION

1. Field of Invention

This invention relates generally to an ice bucket opener to chill champagne and to pull the champagne cork off while the champagne bottle is set inside the bucket.

2. Discussion of Prior Art

Champagne is a drink which is usually chilled with ice before serving. Prior to serving, people may use their thumb to pop off the champagne cork. However, there have been many cases where the projectile of the cork has caused damage to property or injury to people. Upon my prior art searches, I have not found any ice bucket, which has the coordination of functional features to meet with needs of the two related sequences of the chilling and opening champagne in one single device. Therefore, there is a need to make an improvement in this field of art.

SUMMARY AND OBJECTS OF INVENTION

Summary of Invention:

The main structure of the invention is a cylinder ice bucket to contain ice and a bottle of champagne. An elevated base is a flat, circular lid, which is set on the inner circular ridge of the top part of the bucket. A pair of metal latches are connected to the upper rim of the exterior sides of the bucket. The latches are for hooking onto the lid to pull the lid to set on the circular ridge very firmly. The lid has a center, circular opening for the champagne bottle to stick its upper part through the opening. It is to set the bottle neck and cork to be higher than the lid. A block of post base, which has a post hole, is set next to the rim of the center opening of the lid.

Means for extracting, is connected to the lid, for grasping and pulling the champagne cork off, which comprises: An elongated lever post, which is slid into the post hole and locked by a wing type bolt. An elongated lever bar is connected pivotally across the top of the lever post. The rear end of the lever bar is connected with a handle. The front end of the lever bar is set above the upper part of the champagne bottle, and is connected to a cork container by a flexible connector. It is to hang the cork container above the champagne bottle. The cork container has its top end completely enclosed and the lower end has a wide circular opening for any size cork to slide into.

Means for grasping are attached to the exterior of the cork container. The grasping means comprises: Two lever cork grip members which are connected to the side of the cork container. Each of the lever cork grip members has three composite parts connected as a single connecting part: (a) a lower end thin, concave flange which is bent inwardly to be in front of the circular opening of the cork container; (b) a main vertical body part which is connected to the cork container pivotally and vertically, and has an elongated body extended to curve outwardly and upwardly as a lever bar; and (c) an upper vertical handle.

There are two pair of shaft supporting bases of the cork container, which are set across from each other at approximately 180 degrees apart. The two lever cork grip members are set across from each with the two shaft supporting bases. There are four torsion springs. Each set of two torsion springs are set on each shaft and connected to each of the cork grip members to brace against the container. The bracing tension forces the flanges to be in the grasping position or to be set with the smallest opening position between their flanges. The flanges can be opened wider by squeezing on the upper handles towards each other against the tension of the torsion springs.

For the application, simply set the champagne bottle inside the ice bucket. Adjust and set the height of the lever post to align the cork container and the champagne cork. Then press the cork grip handles toward each other to open their flanges wider and slide the cork container to cover the cork; then release the lever handle for the flanges to grasp and lock on the champagne cork. Then use one hand to press the champagne bottle down and use the other hand to press the lever handle to tilt the cork container upwardly in pulling the champagne cork off.

The primary objects of this invention are:

(a) An object is to make a device to meet the needs of the two sequences of chilling and opening a champagne bottle.

(b) Another object is to utilize the height of the lifts position of the ice container as an elevated, solid base to set up the device to match the tall champagne bottle, which is set to chill inside the ice bucket.

(c) Further object is flexibility. The lever post of the device is adjustable for different heights to suite different kinds of champagne bottles.

(d) Further object is for leverage in opening champagne by designing a long lever bar for the extracting means to pull the champagne cork off.

(e) Another object is to save the time and energy of the user in providing two in one device for the user.

(f) Another object is for safety to confine a projectile cork to be inside a cork container after an opening.

(g) Further objects are for convenience and neatness in storage. The extracting means can be taken off the post base to store in the bucket. The lid can be flipped to turn the post base inside the bucket for neatness.

The foregoing objects, advantages, features and results of this invention, together with various other objects, advantages, features, and results thereof which will be in the light of the following detailed descriptions of the preferred embodiments along with the illustrations in the accompanying drawings.

BRIEF DESCRIPTION OF THE DRAWINGS

FIG. 1 shows a perspective top, side view of the invention.

FIG. 2 shows a plane top view of the ice bucket.

DETAILED DESCRIPTION OF INVENTION

Figure 3:
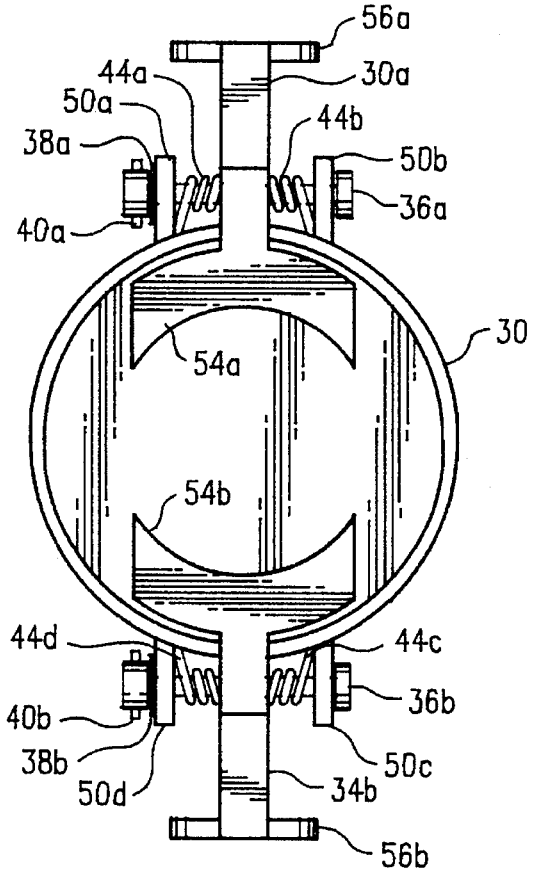
FIG. 3 shows a plane explosion, bottom view of a container.

FIG. 1 shows cylinder shape ice bucket container 10 to contain ice and a champagne bottle. FIG. 2 shows a top plane view of the ice container 10 and its circular inner ridge 11. A flat, round lid 14 is fit to set on the inner circular ridge 11. The container bucket and its lid can be made of a rigid material, either plastic or metal. There are two slidable, metal latch members **12*a* and 12*b*, which are connected to the upper side below the rim of the bucket across from each other. The metal latches 12*a* and 12*b* are for fastening to hook and hold the lid 14 downwardly to be set on the circular ridge 11 of the bucket. It is to secure the lid as a firm, elevated support base. The lid 14 has a round center hole opening for a champagne bottle. The champagne is set in the bucket for chilling. (A champagne bottle is shown with the dotted line B, on FIG. 1, is not a part of this invention.) Its upper part of the bottle neck and cork are set, to stick through the center opening, to be above the lid. A rectangular block of the post support base 18 is made on top of the lid next to the center hole. The post support base structure is slightly inclined to lean toward the side rim of the bucket as a slanted base. A lever post hole 19 is made to open on the top of the post support base and is opened all the way through the bottom side of the lid. The post hole 19 is made in the same direction of slanted angles to conform with the base. On the side of the post support base, a small, horizontal threaded receptacle hole is made for a matching wing type bolt 20** for the locking means. The lid and post support base can be made of a rigid material, either a plastic or metal, through a molding production to form as a single connecting part.

FIG. 1 further shows means for extracting which is connected with the post support base; which comprises: An adjustable lever post 22 is slid into the post hole 19 with a loose-fit relationship. The adjustable post can be adjusted to slide up or down in the post hole 19 for proper height. One side of the lower part of the post has a surface made into a row of cross toothed waves. This cross toothed waves surface area of the lever post is a part of the locking means for a frictional connection with the bolt 20. The wing type bolt 20 can be driven into its matching threaded side hole of the support base 18 to lock on the lever post. An elongated lever bar 24 is connected pivotally across the top of the lever post 22. The connection is secured by a rivet 28. The rear end of the lever bar 24 has a lever bar handle 26 attached. A short metal chain, which is a flexible connector 32 is connected to the front end of the lever bar 24. The lower end of the chain connector 32 is connected to the top end of a cork container 30. The cork container is the main base of the grasping means. The cork container is hung to float above the upper part of the champagne bottle. The lever post can be set for proper height in aligning the cork container with the champagne cork.

Figure 4:
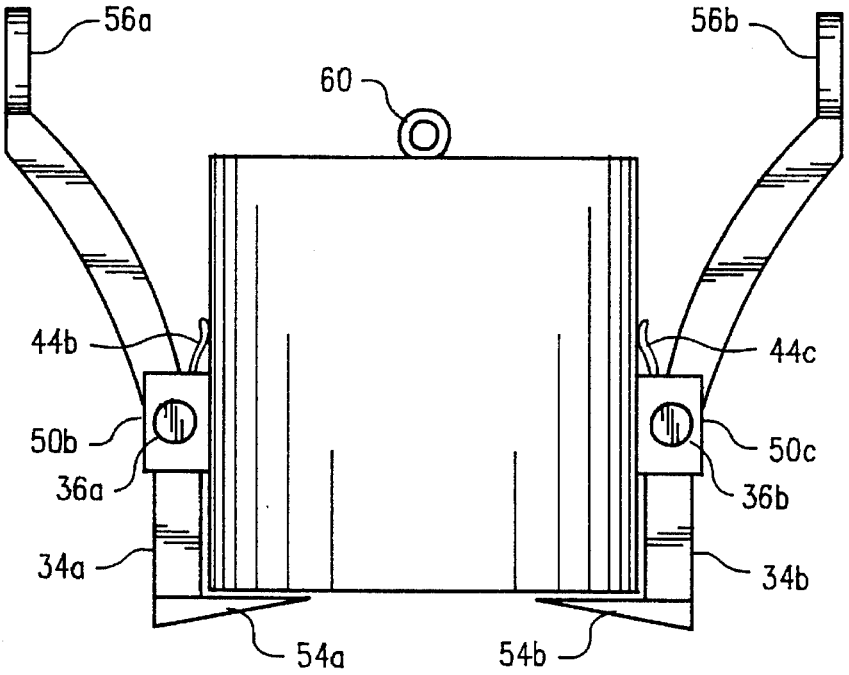
FIG. 4 shows a plane explosion, side view of the container.

FIGS. 3 and 4 are the explosion view to show the cork container 30 and the grasping means functional parts. The cork container 30 is a cylinder shape, hollow container, which has its top part completely enclosed and the bottom part having a circular opening, for a cork to slide in. The cork container is made to be large enough to contain any size of champagne corks. A ring connector 60 is connected to the center, top of the cork container. The chain connector 32 is connected between the ring connector 60 and the front end of the lever bar 24. The connection is to hang the container to float above the champagne bottle. The cork container is the main base for the grasping means the cork container is also utilized to cover and contain the champagne cork for safety.

The grasping means comprises: Two pairs of the vertical shaft support bases, which are made to extend from the lower, exterior side of the container across from each other. Each of the shaft support bases has a pivotal hole made for a pivotal connection. The shaft support bases 50*a* and 50*b* are set on one side, and the shaft support bases 50*c* and 50*d* are set at approximately 180 degrees on the other side of the container. These support bases are for supporting two lever cork grip members 34*a* and 34*b* to be set across from each other. Whereby the cork container, connector ring, and the support bases can be made with a rigid material, either a type of plastic or metal, to form into a single connecting part through a molding production. Each of the lever cork grip members also has three main composites connecting parts which are made of a rigid material, preferably metal, through a molding production to be a single connecting part. The three composites are: (a) a lower end, which has a front end made to form a thin, concave shape of cork grip flange, which is bent approximately 90 degrees inwardly from its main body part to be set in front of the circular opening of the container; (b) a main vertical body part which is connected to the shaft support base pivotally and vertically, and has an elongated body extended to curve outwardly and upwardly to be a lever bar; and (c) a vertical handle which is connected at the top end.

The lever cork grip member 34*a* is connected between the support base 50*a* and 50*b* through a metal shaft rod 36*a*. A flat head shaft rod 36*a* slides through a pivotal hole of the base 50*b*, and through a metal torsion spring 44*b*, cork grip 34*a*, another torsion spring 44*a* and the support base 50*a*. The end of the shaft rod on the other side of the base 50*a*, has a washer 38*a* and a metal, cross rivet pin 40*a* locked upon it to enclosed the connection. The ends of the torsion springs 44*a* and 44*b*, which are next to the center of the shaft, are connected to the body structure of the cork grip 34*a*. The outer and upper ends of the torsion springs are braced against the exterior sides of the container with tension to keep the cork grip in the grasping position. The cork grip member 34*b* and the other pair of the torsion springs are connected in the same manner. The shaft rod 36*b* slides through the base 50*c*, torsion spring 44*c*, cork grip 34*b*, another torsion spring 44*d*, and the base 50*d*. The shaft rod is locked by a washer 38*b* and a rivet pin 40*b* accordingly. The tension of the torsion spring also keeps the cork grip member 34*b* in the grasping position. The effect of the bracing tension of the torsion springs tilted the upper lever handles 56*a* and 56*b* of the cork grip members to be apart from each other at the widest position. On the opposite ends of the lower parts, the flanges 54*a* and 54*b*, are tilted toward each other in front of the circular opening of the container, to face each other with the smallest opening between them. This is the grasping position For the application of this ice bucket champagne opener device, simply set the champagne bottle inside the bucket as shown on the dotted line of FIG. 1. Then adjust the height of the lever post 22 with the base 18 and lock with the bolt 20. The ideal height is when the neck of the champagne cork is level with the flanges 54*a* and 54*b*. Then press the cork grip handles 56*a* and 56*b* toward each other against the tension of the torsion springs to enlarge the opening between the flanges 54*a* and 54*b* to be wider, so that the cork container can be easily slid over to cover the champagne cork. Then release the lever handle for the cork grip flanges to grasp and lock onto the cork's neck. Whereby use one hand to press the upper part of the bottle down firmly, and use the other hand to press the lever bar handle 26 to tilt its front end to lift the cork container 30 upwardly in pulling the cork off.

Although the description above contains a full and complete disclosure of this invention, these should not be construed as limiting the scope of the invention but as merely providing the preferred embodiment of the invention. The various modifications and alternates may be further employed without departing from the scope and spirit of this invention. Therefore, the scope and spirit of the invention should be determined by the appended claims and their legal equivalents.

I claim:

1. An ice bucket champagne opener apparatus for chilling and opening a champagne bottle; comprising:

(a) a rigid ice container structure for containing ice and said champagne bottle;

(b) a rigid, matching lid is attached to cover the top part of said ice container and to be an elevated base;

(c) said lid having a center opening for said champagne bottle to stick its upper part through said center opening; so that the bottle neck and cork of said bottle are set higher than said lid;

(d) a rigid post support base is connected to the top of said lid;

(e) means for extracting connected to said post support base for an aligning, covering and grasping onto said cork; and to pull said cork off with a leverage means.

2. The invention of claim 1 wherein said post support base has a center post hole opening all the way through the bottom side of said lid.

3. The invention of claim 1 wherein said means for extracting, comprises:

(a) a rigid, elongated adjustable lever post is slid into said post hole of said post support base of said lid base;

(b) means for locking is connected to the side of said post support base to lock on said adjustable lever post after said lever post is adjusted for proper height;

(c) a rigid, elongated lever bar is connected pivotally across the top end of said adjustable lever post;

(d) a lever bar handle is connected to the rear end of said lever bar;

(e) a rigid, cylinder, hollow cork container, having the top end completely enclosed, and the bottom end opening for said cork to slide into said cork container;

(f) a flexible connector;

(g) the lower end of said flexible connector is connected to the top end of said cork container; and the top end of said flexible connector is connected to the front end of said lever bar; so that said cork container is held to float above said upper part of said champagne bottle;

(h) means for grasping connected to said cork container to grasp and lock on said champagne cork;

(i) upon said cork being grasped and locked by said grasping means, one can use a hand to press said champagne bottle down; and use the other hand to press said lever handle downward to tilt said container up in pulling said cork off with said leverage means.

4. The invention of claim 3 wherein said cork container has a rigid ring connector connected to the center top for the connection with said flexible connector; and two pairs of vertical shaft supporting bases connected to the lower, exterior sides of said container across from each other for the connection with said grasping means; and said cork container, ring connector and shaft supporting bases are made of a rigid material to form into a single connecting part through a molding production process.

5. The invention of claim 3 wherein said means for grasping, comprises:

(a) a pair of rigid, lever cork grip members;

(b) a pair of rigid shaft rods;

(c) four metal torsion springs;

(d) each of said cork grip members is set between two of said torsion springs, and they are inserted through by each of said shaft rods; and each end of each of said shaft rods is connected pivotally to each of said shaft supporting bases of said cork container;

(e) each of said cork grip members is set with said torsion springs to be on the grasping position constantly.

6. The invention of claim 5 wherein said lever cork grip members, each of which has three composite connecting parts:

(a) a lower end, is made to be a thin concave cork grip flange, which is bent inwardly at approximately 90 degrees from its body structure to be set in front of said opening of said container with a small opening between said flanges;

(b) a main middle, vertical part of said body structure connected pivotally to the shaft base, and is extended to curve outwardly and upwardly as an elongated extending lever bar; and (c) a top end, is made to be a vertical, handle;

(d) said flange, body and handle are made of a metal material to form into a single connecting part of said lever cork grip member through a molding production.

7. An ice bucket champagne opener apparatus for chilling and opening a champagne bottle; comprising:

(a) a rigid ice container structure for containing ice and said champagne bottle;

(b) a rigid, matching lid is attached to cover the top part of said ice container, and to be an elevated base;

(c) said lid having a center opening for said champagne bottle to stick its upper part through said center opening; so that the bottle neck and cork of said bottle are set to be higher than said lid;

(d) a rigid post support base is connected to the top of said lid; and said post support base having a post hole all the way through the bottom side of said lid;

(e) a lever post is set in said post hole of said post support base with a loose-fit relationship; said lever post can be slid up or down for the height adjustment;

(f) means for locking is connected to the side of said post support base to lock on said lever post after said height adjustment is made;

(g) an elongated lever bar is connected pivotal across the top end of said lever post;

(h) a lever bar handle is connected to the rear end of said lever bar;

(i) a flexible connector;

(j) a rigid, cylinder, hollow cork container, having the top end completely enclosed, and the bottom end opening for said cork to slide into said cork container;

(k) the lower end of said flexible connector is connected to the top end of said cork container; and the top end of said flexible connector is connected to the front end of said lever bar; so that said cork container is hung to float above said upper part of said champagne bottle;

(l) means for grasping connected to said cork container to grasp and lock on said champagne cork, (m) whereby one can use a hand to press said champagne bottle down; and use the other hand to press said lever handle downward to tilt said container up in pulling said cork off with said leverage means.

* * * * *